United States Patent [19]

Ishikawa et al.

[11] Patent Number: 4,845,824

[45] Date of Patent: Jul. 11, 1989

[54] CLIP-CLINCHING DEVICE FOR A COIL-SPRING UNIT OF A MATTRESS

[75] Inventors: Fujio Ishikawa, Anjo; Hitoshi Sumiya, Hekinan; Motonobu Oyabu, Toyota; Hideyuki Fukuda, Kariya, all of Japan

[73] Assignee: Aisin Seiki Kabushiki Kaisha, Kariya, Japan

[21] Appl. No.: 161,096

[22] Filed: Feb. 26, 1988

[30] Foreign Application Priority Data

Feb. 27, 1987 [JP] Japan ..... 62-045681

[51] Int. Cl.[4] ..... B23P 11/00

[52] U.S. Cl. ..... 29/243.57; 108/140; 108/143; 901/7

[58] Field of Search ..... 29/243.56, 243.57; 198/344, 345, 339.1, 379, 414; 414/222, 225; 901/7; 108/140, 143

[56] References Cited

U.S. PATENT DOCUMENTS 2,775,333 12/1956 Hayes ..... 198/344
3,641,656 2/1972 Langas et al. ..... 29/243.57
3,665,148 5/1972 Yasenchak et al. ..... 901/7
4,675,969 6/1987 Sciaky et al. ..... 901/7
4,729,536 3/1988 Scala ..... 108/143

FOREIGN PATENT DOCUMENTS 0232999 1/1987 European Pat. Off. ..... 901/7

*Primary Examiner*—Frederick R. Schmidt
*Assistant Examiner*—Judy J. Hartman
*Attorney, Agent, or Firm*—Oblon, Spivak, McClelland, Maier & Neustadt

[57] ABSTRACT

A clip-clinching device for a coil-spring unit includes an arch having a pair of laterally spaced upstanding poles and a horizontal bar connecting upper end portions of the poles. First and second carriers are positioned on the horizontal bar and are movable therealong. First and second members are respectively provided on the first and second carriers and are movable in the vertical direction. First and second clip-clinching tools having projecting tongues at which a jaw is defined are respectively mounted to the first and second members. A base member positioned under the horizontal bar supports a movable coil-spring unit transfer device for movement along a line perpendicular to the horizontal bar.

1 Claim, 3 Drawing Sheets

CLIP-CLINCHING DEVICE FOR A COIL-SPRING UNIT OF A MATTRESS

BACKGROUND OF THE INVENTION 1. (Field of the Invention)

The present invention relates to a clip-clinching device for a coil-spring unit of a mattress.

2. (Description of the Prior Art)

Conventionally, for forming a coil-spring unit 10 of a mattress which is shown in FIGS. 1 through 3, the following steps are required.

(a) Arranging plural coil-springs 11 in a matrix 12 configuration.

(b) Connecting two adjacent coil-springs 11 at the uppermost turn and lowermost turn thereof by helical lacing wires 13.

(c) Setting a border wire 14 having a rectangular configuration about the uppermost turns of the outermost coil-springs 11 in the matrix 12.

(d) Clinching the border wire 14 and the uppermost turn of each outermost coil-spring 11 by a clip 15.

(e) Inverting the matrix 12.

(f) Setting another border wire 16 having a rectangular configuration about the uppermost turns of the outermost coil-springs 11 in the matrix 12.

(g) Performing an operation similar to the operation described above in the above-mentioned step (d).

During the operations described in the above-mentioned steps (d) or (g), an operator handles a clip-clinching tool 17 for clinching open-ended clips 15 (FIG. 4) around adjacent wire members. However, such procedure is not efficient due to the cumbersome steps of inverting the matrix and manually clip-clinching. Furthermore, since the time-duration required for completing the clinching operation is dependent on the operator's characteristics, it is difficult to maintain proper product control in the manufacturing of the coil-spring unit of a matress.

SUMMARY OF THE INVENTION

It is, therefore, a principal object of the present invention to provide a clip-clinching device for a coil-spring unit of a matress by which a coil-clinching operation is performed automatically in the course of forming the coil-spring unit.

It is another object of the present invention to provide a clip-clinching device for a coil-spring unit of a matress in which operations described in the above-mentioned items (d) through (g) are perfomed successively or without interruption.

It is a further object of the present invention to provide a clip-clinching device for a coil-spring unit of a matress comprising (a) an arch having a pair of laterally spaced upstanding poles and a horizontal bar connecting upper end portions of the poles; (b) a first carrier positioned on the horizontal bar and movable therealong; (c) a second carrier positioned on said horizontal bar and movable therealong; (d) a first member provided to the first carrier and movable in the vertical direction; (e) a second member provided to the second carrier and movable in the vertical direction; (f) a first clip-clinching tool having a projecting tongue at which a jaw is defined and mounted to the first member; (g) a second clip-clinching tool having a projecting tongue at which a jaw is defined and mounted to the second member; (h) a base member positioned under the horizontal bar and passing through the arch along a line perpendicular to the horizontal bar; and (i) a transfer means movable on the base member along the line and rotatable through 90 degrees;

According to the present invention, during forward-/rearward movement of the transfer means, the uppermost/lowermost turn of each of outermost springs except top and last springs is clinched to a corresponding side of the border wire by a clip-clinching tool; and during foward/rearward movement of the transfer means after 90 degrees rotation thereof, the uppermost-/lowermost turn of each of outermost springs except the top and last springs is clinched to corresponding lateral side of the border wire by the clip-clinching tool. Thus, clip-clinching operation may be performed successively or automatically.

BRIEF DESCRIPTION OF THE DRAWINGS

Additional objects and advantages of the present invention will become more apparent from the following detailed description of preferred embodiment thereof when considered with referrence to the attached drawings, in which.

DESCRIPTION OF THE PREFERRED EMBODIMENT

Figure 1:
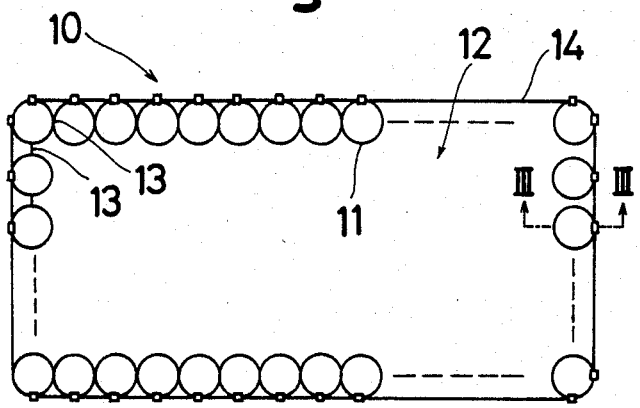
FIG. 1 is a plane view of a coil-spring unit of a mattress.
Figure 2:
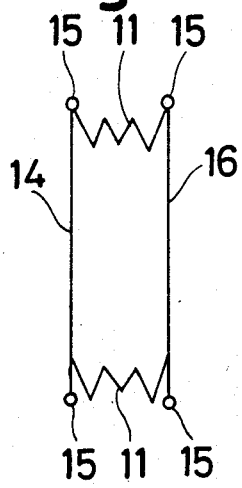
FIG. 2 is a side view of a coil-spring unit in FIG. 1.
Figure 3:
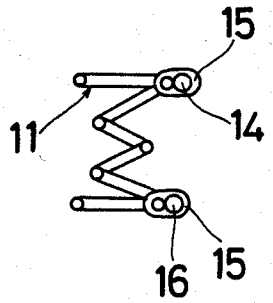
FIG. 3 is a cross-sectional view taken-along the line III—III in FIG. 1.

Referring now to FIGS. 5 through 10, a device 20 for automatically clinching clips by simultaneously positioning clip-clinching tools on opposite sides of a mattress, has an arch 21 which includes a pair of laterally spaced upstanding poles 22·22 and a horizontal bar 23 connecting upper end portions **22*a* of the poles 22. On a right end portion 23*a* and a left end portion 23*b* of the bar 23, there are mounted a bracket 24 and a bracket 25, respectively. A motor 26 is secured to a vertical wall 24*a* of the bracket 24 and a shaft 26*a* of the motor 26 is connected to a right end portion of a spirally-grooved shaft 27. A left end portion of the shaft 27 is connected to a right end portion of a spirally-grooved shaft 28 at a coupling 29 positioned at an intermidiate portion of the bar 23. A left end portion of the shaft 28 is rotatably supported on the bracket 25. On the shaft 27 (the shaft 28), a first carrier 30 (a second carrier 31) is mounted and is movable in the leftward (rightward) direction along a pair of rails 32·32 (a pair of rails 33·33) upon rotation of the shaft 26*a* of the motor 26 in one direction. Thus, the distance between the carriers 30·31 may be adjusted by controlling the rotational angle of the shaft 26*a* of the motor 26**.

Figure 4:
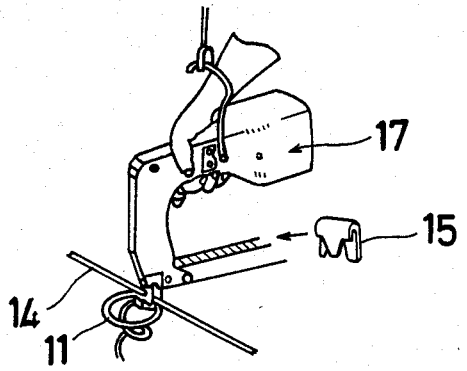
FIG. 4 is a view for illustrating conventional clip-clinching operation.

The first carrier 30 (the second carrier 31) includes a motor 34 (a motor 35) which moves a shaft 36 (a shaft 37) in the vertical direction. The shaft 36 (the shaft 37) is fixed at a lower end portion thereof with a plate member 38 (a plate member 39). On the plate member 38 (the plate member 39), there are fixedly mounted a solenoid 40 (a solenoid 41) from which a plunger 40*a* (a plunger 41*a*) is extended in the downward direction, and a clip-clinching tool 42 (a clip-clinching tool 43) having a trigger 42*a* (a trigger 43*a*) which is in engagement with a hooked end portion (not shown) of the plunger 40*a* (the plunger 41*a*). The clip-clinching tool 42 (the clip-clinching tool 43) has a fowardly projecting tongue 44 (a fowardly projecting tongue 45) defining a jaw 46 (a jaw 47) at which adjacent wire members are clinched by an open-ended clip 48 fed to the tool 42, upon each pull of the trigger 42*a* (the triger 43*a*) due to upward movement of the the plunger 40*a* (the plunger 40*b*) according to the excitation of the solenoid 40 (the solenoid 41). The shape of the open-ended clip 48 is similar to that of the clip in FIG. 4. On a front wall 30*a* (a front wall 31*a*) of the first carrier 30 (the second carrier 31) is mounted a spool 49 (a spool 49A) on which a plurality of open-ended clips in series are wound and are supplied to the clip-clinching tool 42 (the clip-clinching tool 43) one by one at the completion of each clip-clinching operation. The forwardly projecting tongue 44 of the clip-clinching tool 42 is opposed to the fowardly projecting tongue 45 of the clip-clinching tool 43. Detailed construction of the clip-clinching tool 42 (the clip-clinching tool 43) is omitted due to its description in U.S. Pat. No. 3,641,656.

Figure 6:
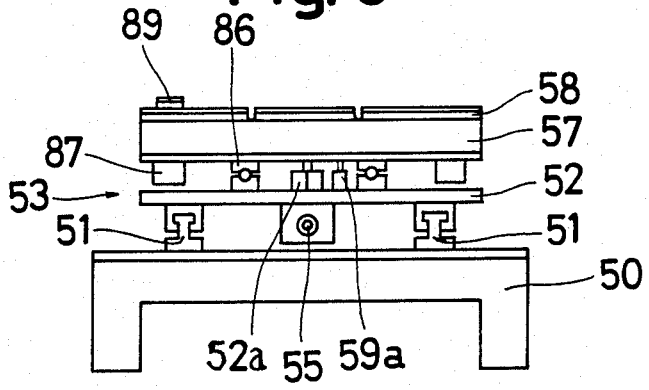
FIG. 6 is a side view of the device in FIG. 5.
Figure 5:
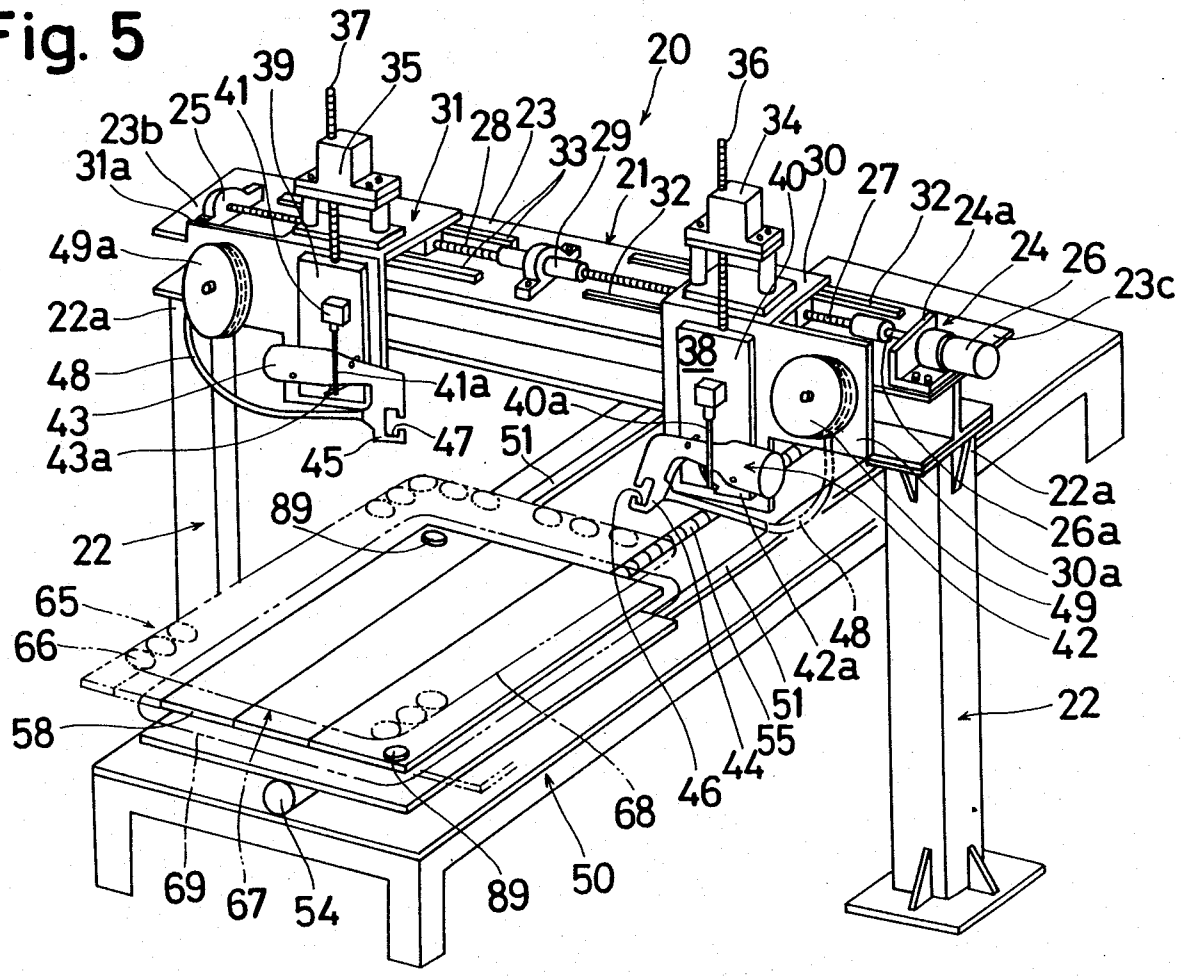
FIG. 5 is a perspective view of a device according to the present invention.
Figure 7:
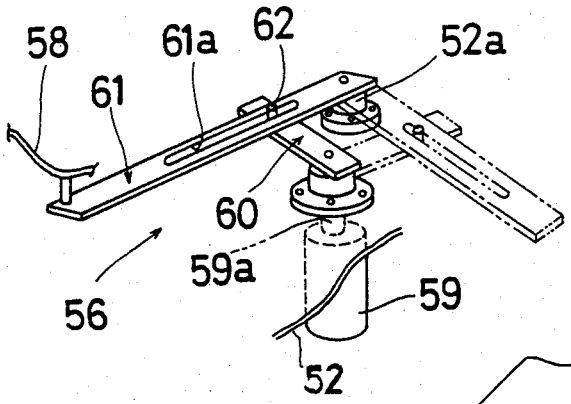
FIG. 7 is a perspective view of a rotating means.

A base member 50 for positioning the mattress is positioned under the bar 23 of the arch 21. On the base member 50, there is fixedly mounted a pair of laterally spaced parallel rails 51 51 along which a lower plate 52 of a transfer means 53 may be moved in the longitudinal direction of the base member 50. For moving the transfer means 53, a motor 54 and a spirally-grooved shaft 55 are employed, similar to the first carrier 30. On the lower plate 52, as a means for presenting front and back sides of the mattress to the clip-clinching tools, there is provided a rotating means 56 is provided so as to support or carry a spacer 57 in the form of rectangular frame configuration and an upper plate 58 mounted thereon. The rotating means 56, as shown in FIGS. 6 and 7, includes a motor 59 with a shaft 59*a*, a first link member 60 connected at a right end portion thereof to the shaft 59*a* of the motor 59 and a second link member 61 pivotted at a right end portion thereof to a portion 52A on the lower plate 52. The second link member 61 is pivotted at a left end portion thereof to the upper plate 58 and has a longitudinal slot 61*a* in which a pin 62 projected from a left end portion of the first link member 60. Upon rotation of the shaft 59*a* of the motor 59 in one direction, the first link member 60 and the second link member 61 are rotated through 270 degrees and 90 degrees, respectively with a result that the first link member 60 rotates the upper plate 58 through 90 degrees. For smooth rotation of the upper plate 58, bearings 86 86 and rollers 87 87 are provided between the upper plate 58 and the lower plate 52.

On the upper plate 58, there is mounted or carried a pre-assembled coil-spring unit 65 which has a plurality of coil-springs 66 arranged in a matrix 67 configuration, an upper border wire 68 having a rectangular configuration about the uppermost turns of the outermost coil-springs 66 the matrix 67 and a lower border wire 69 in having a rectangular configuration about the lowermost turns of the outermost coil-springs 66 in the matrix 67. The uppermost turns of adjacent coil-springs 66 and the lowermost turns of adjacent coil-springs 66 are, respectively, connected with each other by helical lacing wires (not shown). An uppermost turn and a lowermost turn of each coil-spring 66 located at each corner of the matrix 67 is manually clinched to the upper border wire 68 and the lower border wire 69, respectively by open-ended clips at a previous operation. The pre-assembled coil-spring unit 65 is in engagement with a set of projections 89 89 formed on the upper plate 58 so as to prevent relative movement thereto. Each of the border wires 68 69 is projected outwardly from periphery of the upper plate 58 in a plane.

Figure 8:
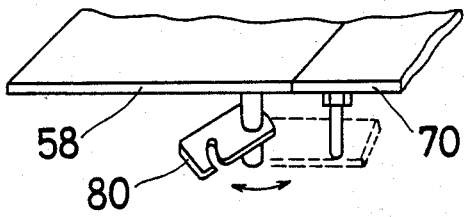
FIG. 8 is a view for illustrating expansion of an upper plate.
Figure 9:
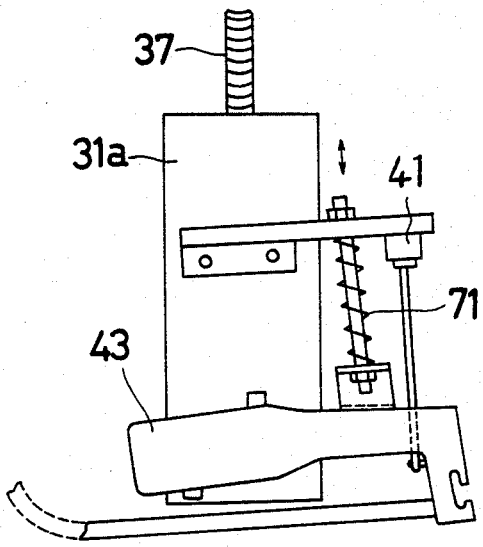
FIG. 9 is a side view around a clip-clinching tool.
Figure 10:
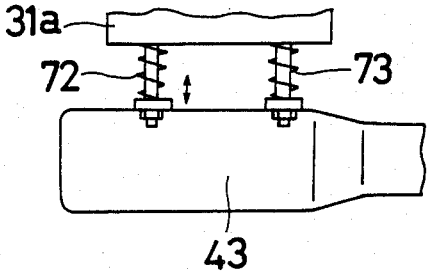
FIG. 10 is a plane view around a clip-clinching tool.

In light of variations of lateral length of the matrix 67, the upper plate 58 may be connected with an additional plate 70 by hook engagement 80 as shown in FIG. 8. For absorbing shock generated from the clip clinching tool 43 at each action thereof, three springs 71, 72 and 73 are employed (FIGS. 9 and 10).

The device 20 is operated as follows.

(1) Distance between the first carrier 30 and the second carrier 31 is adjusted in accordance with width of the pre-assembled coil-spring unit 65 by driving the motor 26.

(2) Height of the clip-clinching tool 42 (the clip-clinching tool 43) is adjusted by driving the motor 34 (the motor 35) in accordance with height of the pre-assembled coil-spring unit 65.

(3) The transfer means 53 is moved frontwardly to a position where an outermost portion of an uppermost turn of a second coil-spring 66 of one longitudinal side (an outermost portion of a uppermost turn of a second coil-spring 66 of the other longitudinal side) of the matrix 67 is in opposition to the tongue 44 (the tongue 45) of the clip-clinching tool 42 (the clip-clinching tool 43) which is in its first original position.

(4) The clip-clinching tool 42 (the clip-clinching tool 43) is moved to the one side (the other side) of the matrix 67.

(5) The outermost portion of the uppermost turn of the second coil-spring 66 of one longitudinal side (the outermost portion of the uppermost turn of the second coil-spring 66 of the other longitudinal side) of the matrix 67 and one longitudinal side (the other longitudinal side) of the upper border wire 68 (the upper border wire 68) are held in the jaw 46 (the jaw 47) of the clip-clinching tool 42 (the clip-clinching tool 43) and are clinched by the open-ended clip 48 due to actuation of the clip-clinching tool 42 (the clip-clinching tool 43) in responding to the upward movement of the plunger 40*a* (the plunger 41*a*) of the solenoid 40 (the solenoid 41) acting on trigger 42*a* (trigger 43*a*) upon exitation thereof.

(6) The clip-clinching tool 42 (the clip-clinching tool 43) is retracted to its first original position.

(7) The transfer means 53 is moved frontwardly by a stroke which is equal to a pitch between the outermost portion of the uppermost turn of the second coil-spring 66 and an outermost portion of the uppermost turn of the coil-spring 66 adjacent thereto in the next direction of movement.

(8) A set of operations described in the above-mentioned items (4) through (7) are performed repeatedly.

(9) Upon completion of clip-clinching to the second coil-spring 66 from the last, the clip-clinching tool 42 (the clip-clinching tool 43) is moved downwardly to its second original position so that the tongue 44 (the tongue 45) thereof is brought into opposition to an outermost portion of an lowermost turn of the second coil-spring 66 from the last of the one longitudinal side (an outermost portion of a lowermost turn of the second from last coil-spring 66 of the other longitudinal side) of the matrix 67.

(10) The clip-clinching tool 42 (the clip-clinching tool 43) is moved at a stroke to the one side (the other side) of the matrix 67.

(11) The outermost portion of the lowermost turn of the second from last coil-spring 66 of one longitudinal side (the outermost portion of the lowermost turn of the second from last coil-spring 66 of the other longitudinal side) of the matrix 67 and one longitudinal side (the other longitudinal side) of the lower border wire 69 (the lower border wire 69) are held in the jaw 46 (the jaw 47) of the clip-clinching tool 42 (the clip-clinching tool 43) and are clinched by an open-ended clip 48 due to actuation of the clip-clinching tool 42 (the clip-clinching tool 43) in response to the upward movement of the plunger 40*a* (the plunger 41*a*) of the solenoid 40 (the solenoid 41) acting on trigger 42*a* (trigger 43*a*) upon exitation thereof.

(12) The clip-clinching tool 42 (the clip-clinching tool 43) is retracted to its second original position.

(13) The transfer means 53 is moved rearwardly at a stroke which is equal to a pitch and the outermost portion of the lowermost turn of the coil-spring 66 between an outermost portion of the lowermost turn of the next coil-spring 66 adjacent thereto in the direction of movement.

(14) A set of operations described in the above-mentioned items (10) through (13) are performed repeatedly.

(15) Upon completion of clip-clinching to the second coil-spring 66 from the first, the clip-clinching tool 42 (the clip-clinching tool 43) is retracted to its upper original position.

(16) The upper plate 58 is rotated through 90 degrees.

(17) Similar operations to (4) through (15) are performed on coil springs at the lateral sides of the matrix 67.

What is claimed is:

1. A clip-clinching device for a coil-spring unit of a mattress comprising:

an arch having a pair of laterally spaced upstanding poles and a horizontal bar connecting upper end portions of said poles; and means for simultaneously positioning two clip-clinching tools on opposite sides of said mattress, including:

(a) a first carrier positioned on said horizontal bar and movable therealong;

(b) a second carrier positioned on said horizontal bar and movable therealong;

(c) a first member provided to said first carrier and movable in a vertical direction;

(d) a second member provided to said second carrier and movable in a vertical direction;

(e) first clip-clinching tool means having a projecting tongue at which a jaw is defined and being mounted to said first member;

(f) second clip-clinching tool means having a projecting tongue at which a jaw is defined and being mounted to said second member;

(g) a base member for positioning said mattress, said base member being positioned under said horizontal bar and passing through said arch along a line perpendicular to said horizontal bar; and (h) coil-spring unit transfer means movable on said base member along said line for presenting lateral mattress sides to said clip-clinching tools, and means for presenting front and back sides of said mattress to said clip-clinching tools including a coil-spring unit support rotatable through 90 degrees, whereby coil-springs of a coil-spring unit on said transfer means may be automatically positioned for clinching by one of said clip-clinching tool means, wherein said transfer means includes a lower plate movable on said base member along said line, an upper plate comprising said coil-spring support and positioned above said lower plate, and a rotating means provided between said plates for rotating said upper plate relative to said lower plate.

* * * * *